US006148555A

United States Patent [19]

Beauchamp et al.

[11] Patent Number: 6,148,555

[45] Date of Patent: Nov. 21, 2000

[54] COVER FOR TEMPORARILY ALTERING TRAFFIC SIGNS

[76] Inventors: Mark A. Beauchamp, 1523 Aldrich Ave., Wichita Falls, Tex. 76302; John A. Burrus, 9 A Mayfair Ter., Wichita Falls, Tex. 76308-1414

[21] Appl. No.: 09/128,335

[22] Filed: Aug. 3, 1998

[51] Int. Cl.[7] ..... G09F 7/02

[52] U.S. Cl. ..... 40/612; 40/611

[58] Field of Search ..... 40/606, 607, 610, 40/611, 612; 150/154; 404/9

[56] References Cited

U.S. PATENT DOCUMENTS

| | | | |
|---|---|---|---|
| 2,064,240 | 12/1936 | Austin | 40/607 |
| 3,182,414 | 5/1965 | Snediker | 40/607 X |
| 3,310,899 | 3/1967 | Hart et al. | 40/607 X |
| 3,479,760 | 11/1969 | Snyder, Jr. | 40/607 |
| 3,726,035 | 4/1973 | Bower et al. | 40/607 X |
| 3,729,847 | 5/1973 | Chandos | 40/607 X |
| 4,765,381 | 8/1988 | Castle | 150/52 |
| 4,771,560 | 9/1988 | Richards | 40/607 |
| 4,885,860 | 12/1989 | Huenefeld | 40/606 |
| 5,197,239 | 3/1993 | Glynn et al. | 52/63 |
| 5,212,898 | 5/1993 | Dinan et al. | 40/607 |
| 5,649,390 | 7/1997 | Davidson | 40/603 X |

FOREIGN PATENT DOCUMENTS

| | | | |
|---|---|---|---|
| 786718 | 9/1935 | France | 40/606 |
| 1085538 | 10/1967 | United Kingdom | 40/611 |

*Primary Examiner*—Terry Lee Melius
*Assistant Examiner*—James M Hewitt
*Attorney, Agent, or Firm*—Jerry C. Ray

[57] ABSTRACT

A cover or envelope having one open end fits over a traffic sign to cover the sign and its message; new information is presented to motorists by appropriate indicia on a front outer surface of the envelope. A rear side of the envelope includes a slit in its center; the slit extends most of the length of the back side and opens to accommodate the bulk of a post or standard on which the sign is mounted. At the bottom, open edge of the cover, metal rods are incorporated into hems on the cover's edge and have protruding loops or tabs thereon; the loops receive a padlock or other means by which the cover is secured in place over the signboard to prevent the cover's unauthorized removal. For a diamond-shaped signboard, two perpendicular slits divide the rear of the cover into triangular panels.

3 Claims, 3 Drawing Sheets

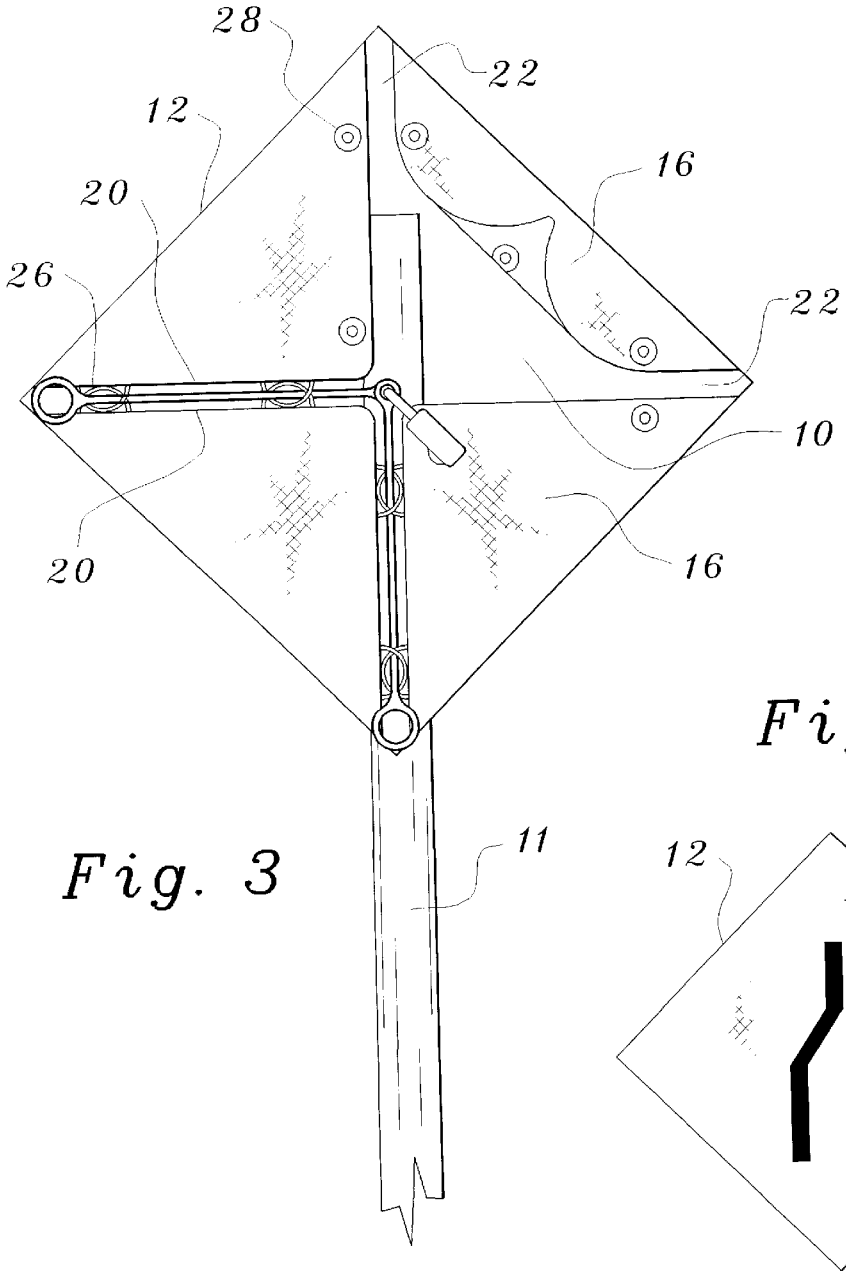
Fig. 3
Fig. 4
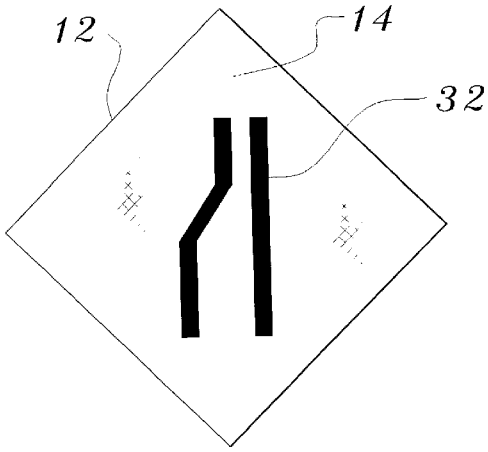

COVER FOR TEMPORARILY ALTERING TRAFFIC SIGNS

CROSS REFERENCE TO RELATED APPLICATIONS:

Not Applicable.

BACKGROUND OF THE INVENTION:

1. Field of the Invention

This invention relates to covers for traffic-control signs, and specifically to such covers which may be temporarily installed and which bear indicia differing from the original information presented by the sign.

2. Description of the Related Art

Every driver is aware that traffic signs must at times be "taken out of service" or otherwise have their message altered. Road construction, detours, hazardous weather conditions, and smoke over the roadway are but a few of the situations where the messages on traffic-control signs require altering for safety purposes. Reduced speed limits are required during many of these situations; presently such changes are accomplished by covering existing signs and erecting temporary signs bearing the new speed limit. In many cases, safety concerns dictate that the changes be effected as quickly as possible. Another situation occurs in cities, where events such as parades, bicycle races, and the like require changes in on-street parking restrictions. In this latter situation, existing signs signifying one- or two-hour parking limits are changed to indicate "No Parking."

A need exists, therefore, for a reusable, temporary cover for road and traffic signs; a cover which can be quickly installed and quickly removed, and which bears the appropriate markings to redirect traffic, restrict parking, indicate a reduced speed limit, etc.

SUMMARY OF THE INVENTION

To temporarily block out a traffic sign and/or to change the sign's message, the present invention provides an opaque cover for a roadway signboard. In addition to blocking the original message or instruction on the sign, the cover conveys an alternate message to drivers. One example, of course, is a zone of reduced speed due to construction on the roadway; covers showing the reduced speed limit are slipped over the existing speed-limit signs in the zone. Appropriate colors are used for the sign covers to attract a driver's attention to the sign, and the front panel of the cover is coated with a reflective material to increase the cover's night-time visibility. It is understood that in construction zones, e.g., some temporary signs may be required in addition to the altered signs; the invention disclosed herein is not intended completely to replace the need for temporary sinage.

The invention includes an envelope of durable material such as a heavy-weight synthetic fabric. Where used on a rectangular signboard, an opening in the form of a slit extends partway up the center of the back of the envelope; the slit is to accommodate the bulk of a post or standard. On a diamond-shaped sign, two generally perpendicular slits are used to divide the rear of the envelope so that it may be installed on a non-rectangular signboard. Loops, buckles, ties, or other means are provided along the edges of the slit for securing the edges together. On a rectangular sign, wire or rod loops extending from the edges of the envelope are locked together by a padlock or the like to secure the cover over the sign.

Based on the above, it is an object of this invention to provide a temporary cover for traffic signs to present a different message to drivers.

Another object of this invention is to provide such a cover which may be locked in place over a sign to prevent unauthorized removal.

A further object is to promote traffic safety by making it easier and faster to change sign information such as speed limits and parking restrictions.

Further objects are to achieve the above with devices that are compact, durable, simple, efficient, and reliable, yet inexpensive and easy to install and maintain.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 3 is a rear elevation of a sign cover installed on a diamond-shaped signboard.

FIG. 4 is a front elevation of a sign cover installed on a diamond-shaped signboard.

CATALOG OF THE ELEMENTS

Figure 1:
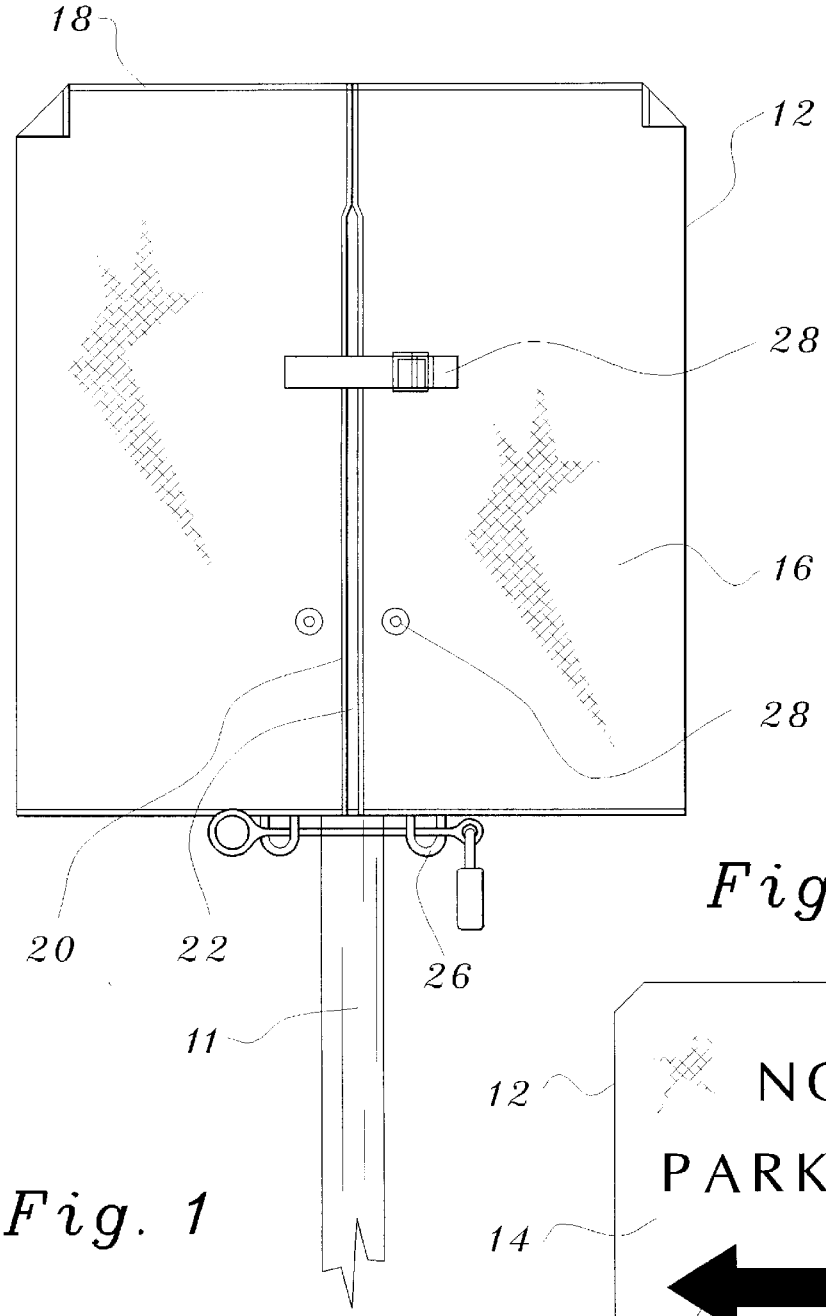
FIG. 1 is a rear elevation of a sign cover installed on a rectangular signboard.

To aid in the correlation of the elements of the invention to the exemplary drawings, the following catalog of the elements is provided:

10 sign
11 post
12 cover
14 front panel
16 rear panel
18 envelope edge
20 panel edge
22 slit
24 locking rod
26 loop or tab
28 fastener
30 lock
32 indicia

DESCRIPTION OF THE PREFERRED EMBODIMENTS

Figure 2:
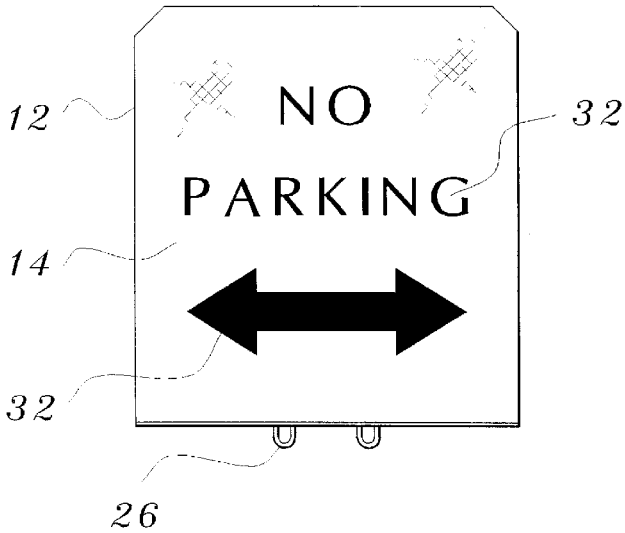
FIG. 2 is a front elevation of a sign cover installed on a rectangular signboard.

Referring now to the drawings, FIGS. 1 and 2 show the rear view and front views, respectively, of a cover 12 for a traffic sign 10 such as a speed-limit sign or the like. "Traffic sign," as used herein, means a signboard having indicia thereon, mounted on a post 11 adjacent a vehicular roadway. The cover 12 is often referred to herein as an "envelope," which means a cover having a substantially unbroken front panel and various arrangements of rear panels with the front and rear panels being joined along two or more of their outer edges. As described below, the envelope folds around a signboard to cover it. Made of a weather-resistant material, including, e.g., a fabric woven of polyvinyl fibers, the sign cover is designed and made for repeated use. Canvas is an alternate material for the envelope, although it is not as weather resistant as many synthetics. Suitable materials also include sheets of synthetic material, bonded at the edges to form an envelope as described below.

Dimensioned to slip easily over a particular size of traffic sign 10, the cover 12 allows a traffic crew to change the information such as a speed limit along a stretch of roadway quickly and efficiently. Indicia 32, as shown in FIG. 2, are displayed on a front panel 14 of cover 12 to convey the modified information to passing motorists. The specific example in FIG. 2 would apply where parking along a city street is being temporarily restricted. Front panel 14 is made reflective by coating with a reflective material or by other means, for better visibility.

Traffic signs which communicate information such as speed limits, etc., are generally rectangular. Other signs warn of hazardous conditions such as sharp curves ahead; these signs often bear symbols rather than words, and are generally diamond-shaped. Different embodiments of the invention provide covers for signs of differing shape.

Cover 12 is made from bonding two pieces of material together along three of their edges to form an envelope open on one edge. The bonded edges of the envelope are designated envelope edges 18. Alternatively, the envelope may be constructed by folding a single piece of material, and bonding along only two sides. Depending on the particular material used for the envelope, bonding is accomplished by sewing, by thermal or adhesive bonding, or by other known methods for bonding plastic materials. An example of a preferred material for the cover 12 is a woven fabric of polyvinyl fiber. Where the material is a woven fabric, the loose edges are hemmed to prevent raveling. The construction results in a cover 12 having a substantially unbroken front panel 14; rear panels 16 are defined by one or more slits 22.

Referring again to FIG. 1, slit 22 in the back of the envelope allows cover 12 to fit over a sign post 11 or standard on which the sign 10 is mounted. Slit 22 provides an adjustable gap between the rear panels 16; the width of the gap is variable and can be adjusted as the cover is secured in place, depending on how bulky the post or standard is. On a cover 12 designed for use on a rectangular signboard, slit 22 divides the rear of cover 12 into two rectangular panels 16. For a diamond-shaped signboard, two slits 22 divide the rear of cover 12 into four triangular panels. Each rear panel 16 includes at least one panel edge 20, which is an edge of the rear panel not bonded to the envelope proper. A portion of panel edge 20 along each side of the slit 22 has a series of fasteners 28 for securing the two loose sides of the slit to each other. The fasteners may be straps with buckles, as shown in FIG. 1, or grommets for receiving ties.

For use on a rectangular signboard, one edge of the envelope is open to allow the cover 12 to be slipped over a sign 10 like a sock; in normal use the open edge would be at the bottom of the sign board. Loops 26 of metal rod, wire, cable, or other suitable material are provided along both sides of the opening. The rear side of the cover is divided by the slit 22 as described previously.

Figure 5:
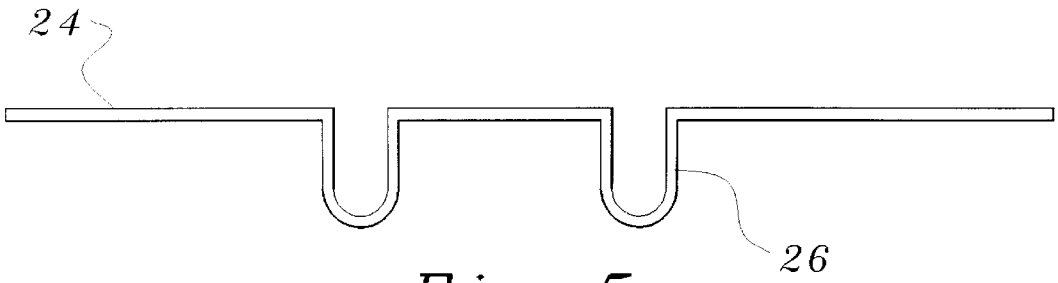
FIG. 5 is a front elevation of a locking rod, showing loops which are locked to matching loops on another edge of the cover.
Figure 6:
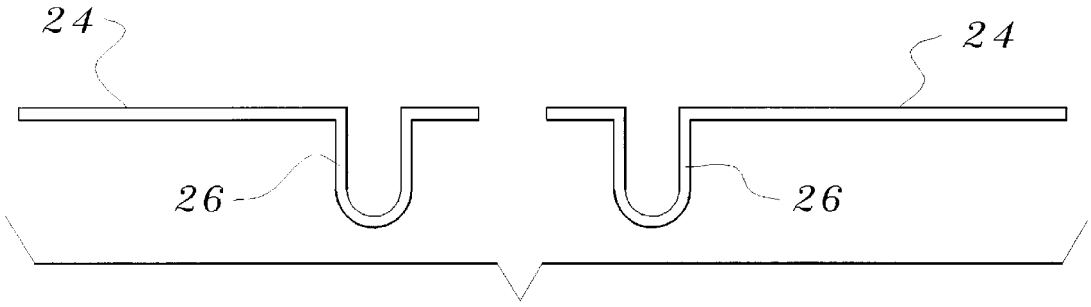
FIG. 6 is a front elevation of two locking rods for use on either side of a slit rear of the cover.
Figure 7:
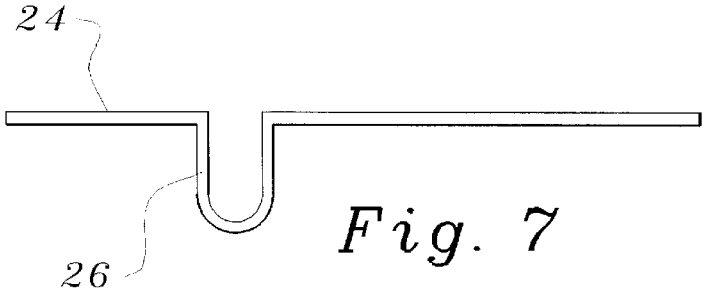
FIG. 7 is a front elevation of alternate configuration of a single locking rod.

Metal rods 24 as shown in FIGS. 5, 6, and 7 are used to reinforce panel edges 20 on the rear of the envelope and to provide means for locking the envelope on a signboard. Sewn into the hem of a panel edge 20 or otherwise secured to a panel edge, each rod 24 includes loops 26 which extend beyond the panel edge to provide means for securing each rear panel to the front panel of the envelope, so that the envelope is closed around the signboard. Where plastic sheeting is used to form the envelope, an edge of the material is folded back and bonded to itself to form an enclosure for rod 24. Openings in the rod enclosure allow rod loops 26 to protrude beyond the envelope edge 18, as shown in FIGS. 1 and 3. The loops 26 are not actual spirals in rod 24, i.e., not complete loops, but are triangular tabs formed by three bends in the rod. A padlock (not shown) is used for security, to prevent unauthorized removal of the cover, with the shackle of the padlock passing through two adjoining loops. A combination of fasteners 28, together with one or more padlocks on loops 26 is used to secure the cover in place.

Another embodiment of the sign cover is shown in FIGS. 3 and 4. Many advisory signs on the roadway are displayed in a diamond configuration; these signs warn of hazards ahead, including intersections, curves, etc. This alternate embodiment of the invention is made to cover such diamond-shaped signs. To accommodate the diamond shape, the envelope has two perpendicular slits across its back. As seen in FIG. 3, the slits form four triangular-shaped panels on the back of the sign cover. Each panel has, along its edges, means for securing it to adjacent panels. The attachment means, or fasteners, may include buckles, ties secured to the cover, grommets for use with ties or bungee cords, etc., as described for rectangular signboards. Both grommets and wire loops are shown in FIG. 3 only to illustrate their appearance, and not to signify that both are necessarily used on the same sign cover.

In use, a stockpile of sign covers is maintained by a municipality or other entity responsible for street or highway safety. When a need arises, e.g., to lower the speed limit along a stretch of street due to construction, covers bearing the appropriate new speed limit are removed from stock. Alternatively, of course, blank covers or repainted covers may have the new speed limit applied to them. A traffic crew then moves along the roadway, covering each speed limit sign with a cover. The result is that the new speed limit is displayed prominently on existing signs, in the same place that motorists are accustomed to looking. In the event of road construction ahead, a diamond-shaped sign might be covered with symbols as shown in FIG. 4, showing that a lane is closed ahead.

The restrictive description and drawings of the specific examples above do not point out what an infringement of this patent would be, but are to enable one skilled in the art to make and use the invention. Various modifications can be made in the construction, material, arrangement, and operation, and still be within the scope of my invention. The limits of the invention and the bounds of the patent protection are measured by and defined in the following claims.

What is claimed is:

1. A temporary cover for a traffic sign, comprising:

an envelope having a front and a rear, said envelope being sized to fit over and enclose the sign, said envelope having one or more slits in said rear to accommodate a support post, said slit dividing said rear into two or more rear panels, each said rear panel having one or more panel edges, means for securing said envelope in place on the sign, means for locking said envelope in place on the sign, said means for locking including a metal rod included in at least one panel edge and a metal rod included in at least one envelope edge, each said rod including at least one loop therein, each said loop extending beyond an edge containing said loop through an opening in said edge, a loop being adjacent to another loop in another rod to form a matching pair of loops, one said loop lockable to another said loop.

2. The invention as described in claim 1, wherein said metal rod included in at least one panel edge is contained within a hem on said panel edge.

3. A method for temporarily altering a traffic sign having indicia thereon, including the following steps:

providing a cover for the traffic sign, said cover being an envelope with at least one side of the envelope including indicia different from indicia on the sign, placing said cover on the traffic sign so that the sign is covered and said indicia on said cover is visible to motorists, securing said cover in place on the sign by including a metal rod contained within a hem on an edge of said cover, said metal rod having at least one loop extending beyond said edge of said cover so that one or more loops on adjacent edges form at least one matching pair of loops, locking at least one said matching pair of loops together to secure said cover on said sign, allowing said cover to remain in place until information displayed thereon is no longer needed, and removing said cover.

* * * * *